US008932048B2

(12) United States Patent
Rodriguez-Medina et al.

(10) Patent No.: US 8,932,048 B2
(45) Date of Patent: Jan. 13, 2015

(54) SHOCK ABSORBING ASSEMBLY FOR GAS IGNITER

(75) Inventors: Miguel A. Rodriguez-Medina, Cabo Rojo, PR (US); William Burgos-Pabon, Isabela, PR (US)

(73) Assignee: Surface Igniter LLC, Chagrin Falls, OH (US)

( * ) Notice: Subject to any disclaimer, the term of this patent is extended or adjusted under 35 U.S.C. 154(b) by 910 days.

(21) Appl. No.: 12/780,440

(22) Filed: May 14, 2010

(65) Prior Publication Data

US 2010/0291498 A1 Nov. 18, 2010

Related U.S. Application Data

(60) Provisional application No. 61/178,644, filed on May 15, 2009.

(51) Int. Cl.

| | |
|---|---|
| ***F23Q 7/06*** | (2006.01) |
| ***F23Q 7/08*** | (2006.01) |
| ***F23Q 7/00*** | (2006.01) |
| ***F23Q 7/22*** | (2006.01) |
| ***H05B 3/02*** | (2006.01) |
| ***F23Q 7/24*** | (2006.01) |

(52) U.S. Cl.

CPC ... *F23Q 7/22* (2013.01); *F23Q 7/24* (2013.01)
USPC ..... 431/258; 431/259; 219/260; 219/267; 219/551; 361/264

(58) Field of Classification Search

USPC ..... 431/258, 259; 219/260, 267, 551; 361/264

See application file for complete search history.

(56) References Cited

U.S. PATENT DOCUMENTS

| | | | | |
|---|---|---|---|---|
| 4,176,903 | A | 12/1979 | Cairo et al. | |
| 4,177,034 | A | 12/1979 | Jones | |
| 6,056,540 | A * | 5/2000 | Newman et al. | 431/264 |
| 6,664,514 | B1 | 12/2003 | Marshall | |
| 7,626,141 | B2 | 12/2009 | Rodriguez-Medina et al. | |
| 2004/0206856 | A1 | 10/2004 | Cordero et al. | |
| 2007/0215591 | A1 | 9/2007 | Rodriguez-Medina et al. | |

OTHER PUBLICATIONS

International Preliminary Report on Patentability dated Nov. 15, 2011 in corresponding International Patent Application No. PCT/US2010/034941, filed May 4, 2010.

SUPCO Promotional material; Sealed Unit Parts Co., Inc.; Allenwood, New Jersey, Aug. 2006.

* cited by examiner

*Primary Examiner* — Kenneth Rinehart
*Assistant Examiner* — William Corboy
(74) *Attorney, Agent, or Firm* — Rankin, Hill & Clark LLP

(57) ABSTRACT

A gas igniter includes a heating element, a bushing and a mounting bracket. The bushing is formed of a generally rigid electrically insulating material and supports the heating element. The bushing includes an elongated slot extending through the bushing. The mounting bracket includes a first connecting portion and a second mounting portion. The first connecting portion is inserted through the elongated slot located on the bushing for connecting the mounting bracket to the bushing. The second mounting portion is configured to attach the gas igniter to an associated support surface.

22 Claims, 4 Drawing Sheets

SHOCK ABSORBING ASSEMBLY FOR GAS IGNITER

This application claims the benefit of provisional patent application Ser. No. 61/178,644, filed May 15, 2009, which is incorporated by reference in its entirety herein.

BACKGROUND

Exemplary embodiments herein generally relate to gas igniters. More particularly, the present disclosure is directed to a shock absorbing assembly for a gas igniter.

It is well known that a gas igniter can be used to ignite a flammable gas for use in connection with all types of heating applications. Further, it is well known that the gas igniter must be supported relative to a support surface located in the heating apparatus so that the gas igniter is properly oriented relative to the gas flow. In order to support the gas igniter, a mounting device or bracket is generally connected to the gas igniter. The mounting bracket can be securely fastened to the gas igniter without damaging the gas igniter and can be securely fastened to the support surface in the heating apparatus. Further, the mounting bracket must be capable of withstanding the environments in which the gas igniter is to be used. In this respect, gas igniters are used to ignite a flammable gas which, in turn, is used to provide the heat for the heating apparatus. As a result, the gas igniter and mounting bracket are subjected to high temperatures produced by the burning gas. In addition, during the function of igniting the gas and the operation of the heating apparatus, the gas igniter and mounting bracket are subjected to vibrations. Due to the adverse conditions in which the gas igniter and bracket are used, it is common practice to produce the mounting bracket from a thin sheet metal corrosion resistant metal.

An example of a conventional gas igniter 50 is shown in FIG. 1. The gas igniter 50 includes an igniting or heating element 52, a bushing 54 and a mounting device or bracket 56. Lead wires 58 are electrically connected to the heating element. The bracket includes a U-shaped portion 60 dimensioned to securely receive the bushing 54. The bushing can include a surface artifact (not shown) that projects from the surface and is configured so as to mechanically engage an aperture (not shown) in the bracket 56. The bracket 56 further includes a flange portion 70 connected to the U-shaped portion 60. The flange portion 70 includes a pair of through apertures 72, 74 by which the bracket 56 is secured to the support surface of the heating apparatus, thereby also securing the gas igniter 50 to the support surface. The connection of the bracket 56 to the bushing 54 is done manually to be effective.

While known mounting brackets for gas igniters, such as bracket 56 of FIG. 1, are designed to adequately maintain the gas igniter in an operating position relative to the support surface of the heating apparatus, conventional brackets do not sufficiently withstand and absorb shock and vibrations produced by the heating apparatus while maintaining the proper orientation of the heating element of the gas igniter. This, in turn, reduces the life expectancy of the gas igniter. Further, the known mounting brackets are relatively expensive and require a number of formed sheet metal components and a multitude of assembly operations. Thus, there is a commercial need for a mounting device or bracket to be used with a gas igniter which sufficiently absorbs shock, but involves use of less metal, has a lower cost and requires fewer assembly operations.

BRIEF DESCRIPTION

In accordance with one aspect, a gas igniter comprises a heating element, a bushing and a mounting bracket. The bushing is formed of a generally rigid electrically insulating material and supports the heating element. The bushing includes an elongated slot extending through the bushing. The mounting bracket includes a first connecting portion and a second mounting portion. The first connecting portion is inserted through the elongated slot located on the bushing for connecting the mounting bracket to the bushing. The second mounting portion is configured to attach the gas igniter to an associated support surface.

In accordance with another aspect, a gas igniter comprises a heating element having rear poles, a bushing for supporting the heating element and a mounting bracket. The bushing is rectangular shaped and is formed of a generally rigid electrically insulating material. The bushing defines a first cavity and a second cavity. The first and second cavities are adapted to laterally receive and electrically isolate the rear poles of the heating element. The bushing includes a laterally oriented slot extending through the bushing. The mounting bracket including a connecting portion. The connecting portion is inserted through the slot, an end section of the connecting portion being configured to engage the bushing for connecting the mounting bracket to the bushing.

In accordance with yet another aspect, a flat igniter comprises a heating element having rear poles, a bushing for supporting the heating element and a mounting bracket. The bushing is rectangular shaped and is formed of a generally rigid electrically insulating material. The bushing defines a first cavity and a second cavity separated from the first cavity by a laterally extending wall. The first and second cavities are adapted to laterally receive and electrically isolate the rear poles of the heating element. An elongated slot is located on the wall and extends through the bushing. High temperature ceramic adhesive is located in the first and second cavities for fixedly securing the rear poles of the heating element in the bushing. The mounting bracket includes a connecting portion and a mounting portion. The connecting portion is inserted through the elongated slot. An end section of the connecting portion extending through the slot includes at least one bendable flap configured to engage the bushing for firmly connecting the mounting bracket to the bushing. The mounting portion is configured to attach the flat igniter to an associated support surface.

DETAILED DESCRIPTION

It should, of course, be understood that the description and drawings herein are merely illustrative and that various modifications and changes can be made in the structures disclosed without departing from the present disclosure. It will also be appreciated that the various identified components of the exemplary gas igniter disclosed herein are merely terms of art that may vary from one manufacturer to another and should not be deemed to limit the present disclosure. The present disclosure is particularly applicable for use in connection with heating applications. However, the present disclosure has broader applications and may be used with any type of appliance and/or heating apparatus which utilizes a gas igniter.

Figure 3:
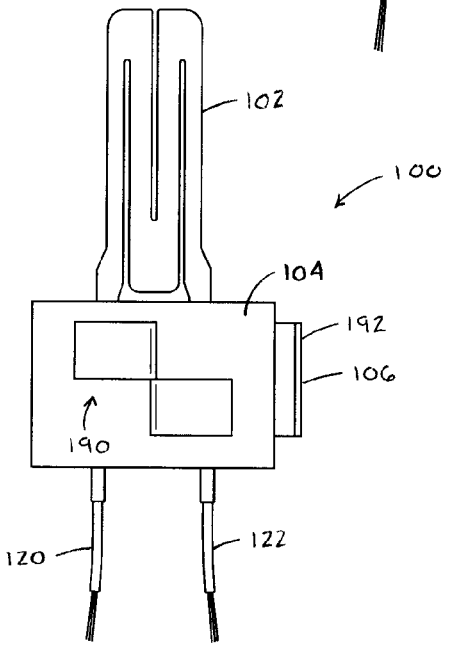
FIG. 3 is a front view of the gas igniter of FIG. 2.
Figure 2:
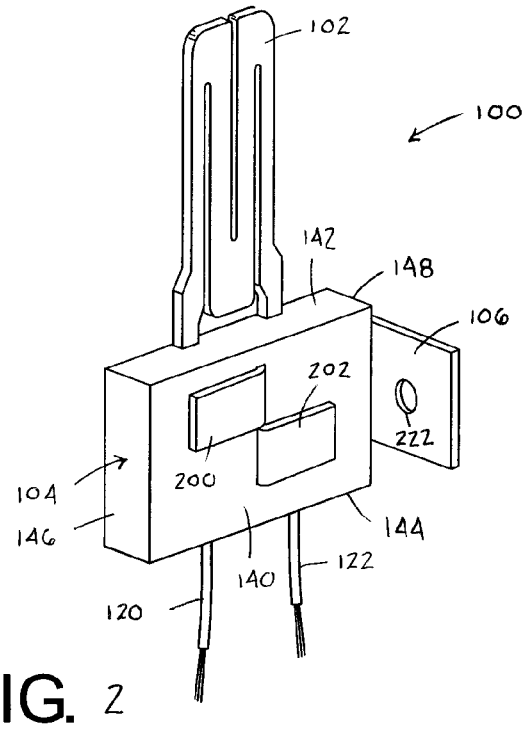
FIG. 2 is a perspective view of an exemplary gas igniter according to the present disclosure, the exemplary gas igniter including a heating element, a bushing for supporting the heating element and a mounting bracket.

Referring now to the drawings, wherein like numerals refer to like parts throughout the several views, FIGS. 2 and 3 illustrate an exemplary gas igniter 100 according to the present disclosure. The gas igniter 100 is a hot surface flat igniter used to ignite a flammable gas for use in connection with all types of heating appliances. The gas igniter 100 generally comprises a heating element 102, a bushing 104 and a shock absorbing assembly or mounting bracket 106.

Figure 4:
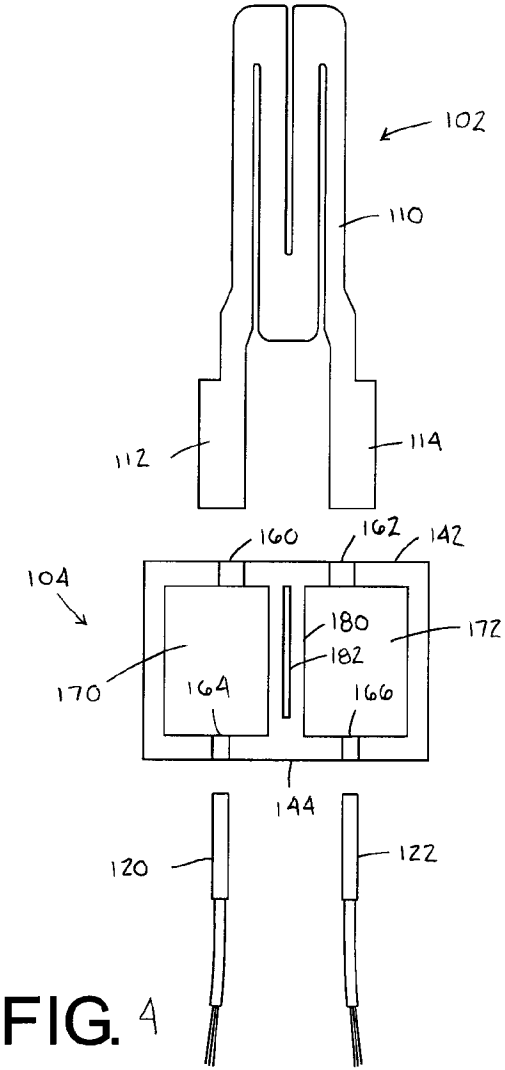
Figure 10:
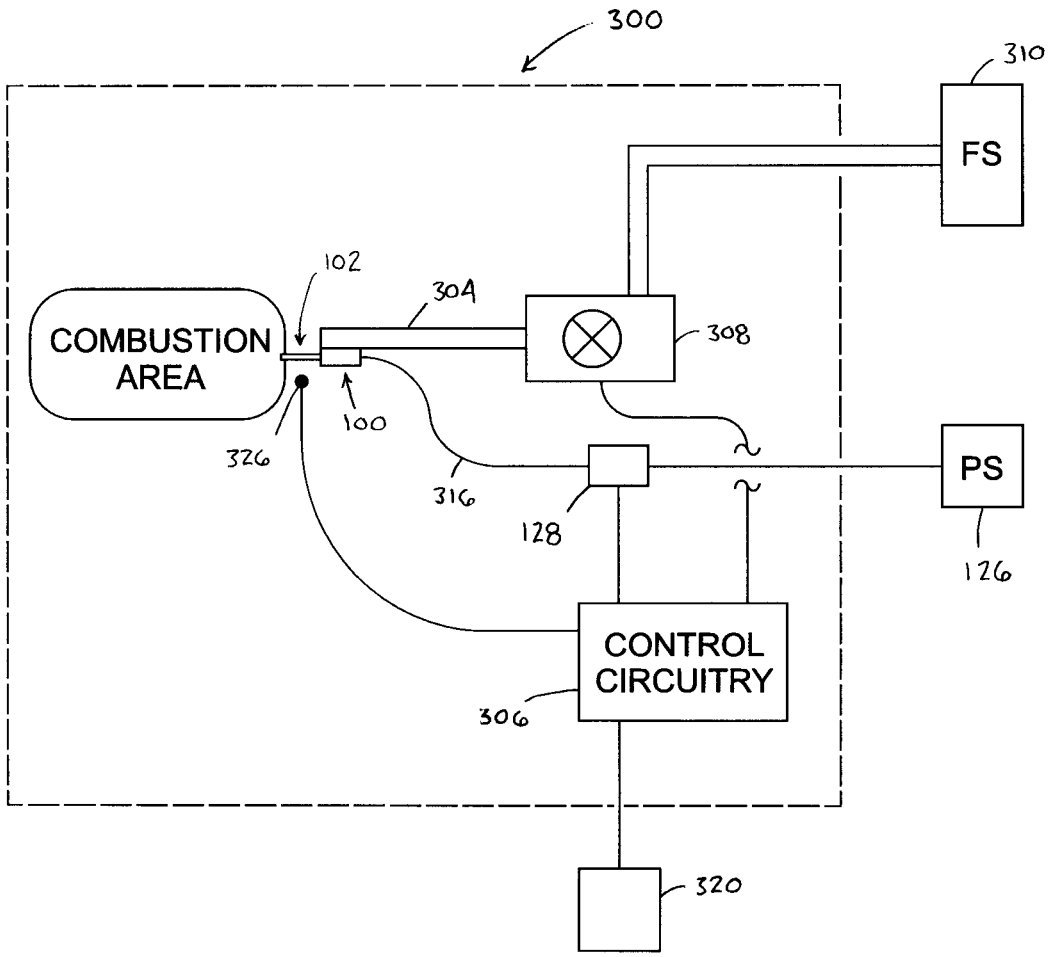
FIG. 10 is a simplified schematic view of a heating apparatus having the gas igniter of FIGS. 2 and 3 mounted to a support surface.

With reference to FIG. 4, the heating element 102 for use with the flat igniter 100 includes a generally rectangular shaped coil 110 and rear poles or terminals 112, 114. The coil 110 extends outwardly from the bushing 104 which it is secured to and is formed of a high resistance heating material The rear poles 112, 114 are connected to respective input leads 120, 122 to cause rapid heating of the coil 110. As explained further below in connection with FIG. 10, these input leads 120, 122 are selectively and electrically interconnected to an electrical power source 126 through an electrical power switch 128. As is known in the art, the heating element 102 of the gas igniter 100 is heated to a desired temperature by passing an electrical current through the heating element, similar in principle to the electrical heating element for a conventional stove, for the purposes of igniting a flammable gas of a heating appliance 300 (FIG. 10).

Figure 5:
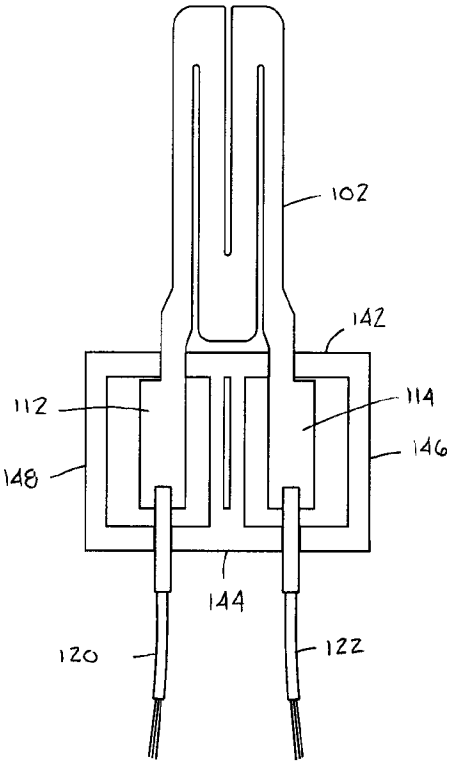

The bushing 104 is formed of a generally rigid electrically insulating material and supports the heating element 102. As shown in FIGS. 2, 4 and 5, the bushing 104 is generally rectangular shaped and includes a base 140, sidewalls 142, 144 and end walls 146, 148. The sidewalls and the end walls extend outwardly from the base. Located on sidewall 142 are a pair of spaced apart first notches or openings 160, 162 dimensioned to receive the rear poles 112, 114 of the heating element 102. A pair of spaced apart second notches or openings 164, 166 are located on sidewall 144 and are dimensioned to receive the input leads 120, 122. The base together with the opposed sidewalls and opposed end walls define a first cavity 170 and a second cavity 172. The first and second cavities 170, 172 are adapted to laterally receive and electrically isolate the rear poles 112, 114 of the heating element 102.

To electrically isolate the rear poles, the first and second cavities 170, 172 are separated by a wall 180. In the depicted exemplary embodiment, the wall 180 extends laterally between the sidewalls 142, 144 to separate the first and second cavities 170, 172. The wall 180 includes a slot 182 which extends through the bushing 102. The elongated slot extends laterally between the sidewalls 142, 144 and is equally spaced from the end walls 146, 148. Each end portion of the elongated slot 182 is spaced from one of the sidewalls of the bushing 104. As will be discussed in greater detail below, the slot is dimensioned to receive a connecting portion 190 of the mounting bracket 106. To secure fixedly secure the rear poles 112, 114 of the heating element 102 in the bushing 104, an adhesive 184 is provided in the first and second cavities 170, 172. According to one aspect, the adhesive is high temperature ceramic cement; although, alternative adhesives are contemplated.

Figure 7:
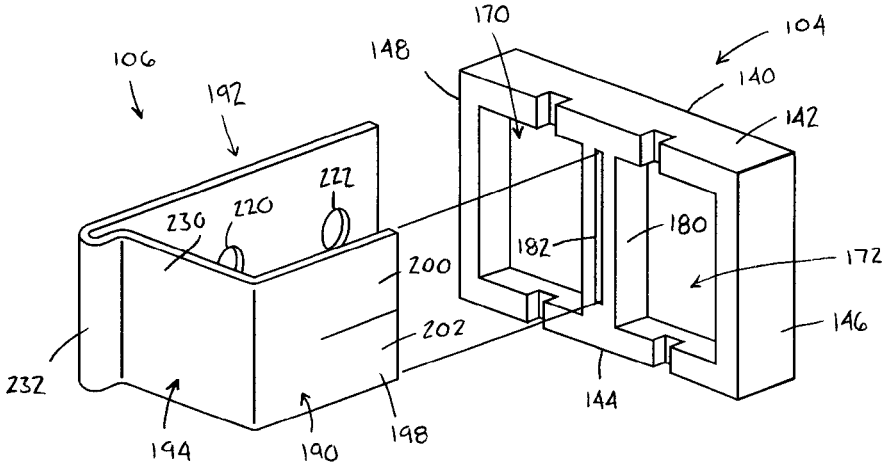
FIG. 7-9 illustrate a second partial assembly of the gas igniter of FIGS. 2 and 3, particularly the connection of the mounting bracket to the bushing
Figure 8:
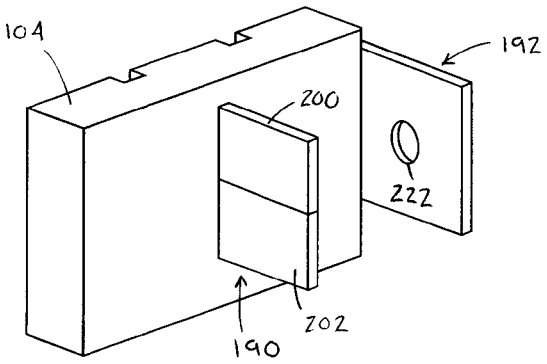
Figure 9:
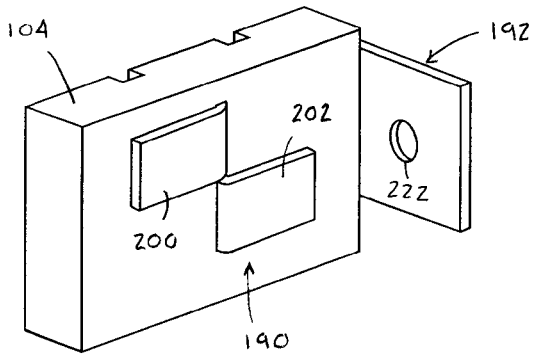

With reference now to FIGS. 7-9, the mounting bracket 106 supports the bushing 104 of the gas igniter 100 to a remote external support surface or structure 304 (FIG. 10) so that the gas igniter 100 is in the proper position for efficient ignition of the flammable gas of a heating appliance. The mounting bracket 106 is capable of withstanding high temperatures created by the burning gas. In addition, because the gas igniter 100 and bracket 106 are both subjected to intermittent vibrations, the mounting bracket 106 is generally rigid and capable of absorbing shock, while maintaining the proper orientation of the heating element 102 of the gas igniter 100. Due to the adverse conditions in which the gas igniter 100 and mounting bracket 106 are used, the mounting bracket is produced from a single sheet of shock resistant, corrosion resistant metal.

The mounting bracket 106 is generally U-shaped and includes the connecting portion 190, a mounting portion 192 and a base portion 194 which spans between the connecting and mounting portions. The connecting portion 190 is inserted orthogonally through the elongated slot 182 located on the wall 180 of the bushing 104. According to one aspect, an end section 198 of the connecting portion 190 that extends through the elongated slot 182 includes at least one tab or flap which can be folded or bent towards the base 140 of the bushing 104 for firmly connecting the mounting bracket to the bushing. In the depicted embodiment, the at least one flap include a first flap 200 and a second flap 202 which are folded in opposite directions toward the base 140. As shown, the first flap 200 is folded towards sidewall 142 and the second flap is folded towards sidewall 144. This attachment of the bracket 106 to the bushing 104 simplifies the automation of the assembly. It should be appreciated that the first and second flaps 200, 202 are sufficiently sized to prevent the connecting portion 190 of the bracket 106 from moving out of the elongated slot 182. For example, the combined length of the folded first and second tabs 200, 202 is about one-half the length of the bushing 104.

Figure 6:
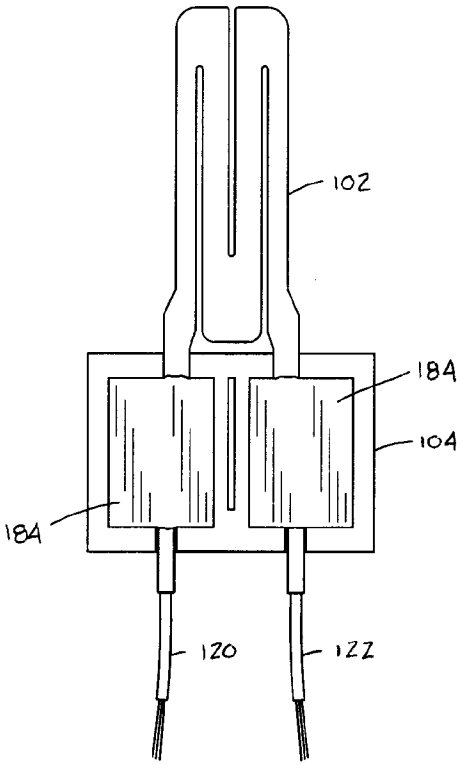
FIGS. 4-6 illustrate a first partial assembly of the gas igniter of FIGS. 2 and 3, particularly the connection of the heating element to the bushing.

As depicted in FIGS. 4-6, to assemble the gas igniter 100, the rear poles 112, 114 of the heating element 102 are positioned in the first and second cavities 170, 172. The input leads 120, 122 are connected to the rear poles. To firmly secure the heating element 102 to the bushing 104, the first and second cavities 170, 172 are then filled with the adhesive 184. As shown in FIGS. 7-9, the connecting portion 190 is inserted through the slot 182 on the wall 180 until the end section 198 projects outwardly from the base 140 of the bushing 104. The first and second tabs 200, 202 located on the end section 198 are then folded in opposite directions against the base 140. According to another exemplary embodiment, an adhesive passage (not shown) can be provided in the wall 180. This allows the adhesive 184 to flow between the first and second cavities 170, 172. Prior to the adhesive hardening, the bracket 106 is connected to the bushing 104 in the same manner described above. According to this aspect, the connecting portion 190 will pass through the adhesive 184 located in the passage, the adhesive further securing the mounting bracket 106 to the bushing 104.

The mounting portion 192 of the mounting bracket is configured to attach the gas igniter 100 to the associated support surface 304 (FIG. 10). According one aspect of the present disclosure, the mounting portion 192 includes spaced apart mounting apertures 220, 222 by which the bracket 106 is secured to the associated support surface. For example, threaded ends of fasteners, such as bolts, can extend through the apertures 220, 222 and corresponding apertures in the support (not shown) and threadably received in the threaded apertures of nuts (not shown). As is known in the art, the nuts and fasteners are tightened thereby securing the mounting bracket 106 to the support surface 304. In this way, the gas igniter 100 is directly secured to the support surface 304 of a heating device, which support surface can be the burner tube of the heating device 300 (FIG. 10).

Although a nut and bolt type of connection is described above, this shall not constitute a limitation on the mechanism that secures mounting bracket 106 of the gas igniter 100 to the support surface 304. For example, the apertures in the support can be a threaded aperture in which is threadably received the threaded ends of the bolts. The fasteners also can be a well known self-tapping screws that can be screwed into corresponding blind holes comprising the apertures in the support. Also the support surface can be configured with studs that extends outwardly from the support. The apertures 220, 222 can be slotted and secured to the studs using any of a number of techniques known to those skilled in the art. Such examples are illustrative of a few techniques for securing the mounting portion 106 to the support surface 304 and thus shall not be construed as limiting the different ways in which the gas igniter 100 can be secured to the support surface.

With reference again to FIG. 7, the base portion 194 of the mounting bracket 106 has an offset section 230 and an arcuate section 232. This offset section 230 is connected to the an end of the connecting portion 190 so that a length of the connecting portion is less than a length of the mounting portion 192. The arcuate section 232 is connected to an end of the mounting portion 192. As indicated previously, to secure the bracket 106 to the bushing 104, the connecting portion is inserted through the elongated slot 182. The first and second tabs 200, 202 are then folded onto the base 140 of the bushing. Once secured, the offset section 230 of the base portion 194 together with the connecting portion 190 lifts the bushing 104 away from the mounting portion 192. In other words, the bushing is spaced from the mounting portion by the arcuate section 232. This allows the mounting portion 192 to be easily attached to the support surface via one of the exemplary manners described above. Further, because the gas igniter 100 and mounting bracket 106 are both subjected to intermittent vibrations, by spacing the bushing 104 from the support surface via the arcuate section 232, at least some of the intermittent vibrations can be dampened by the arcuate section.

Figure 1:
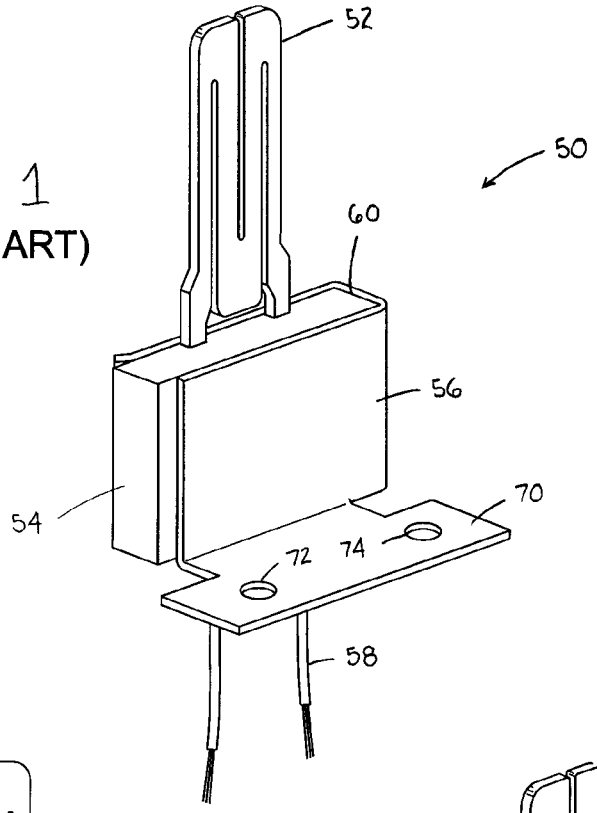
FIG. 1 (PRIOR ART)
FIG. 1 is a perspective view of a known gas igniter.

As indicated above, the bushing 104 is secured to the support surface 304 and is configured to make the gas igniter 100 more resistant to external loads, such as external impact loads, occurring during manufacturing, shipping and handling or during installation of the heating device. In other words, a larger percentage of the external loads being applied to the gas igniter 100 during manufacturing, shipping and handling or during installation of the heating device, in particular external impact loads, do not cause a failure of the gas igniter 100 as compared to the loads causing failures of ignition devices that are secured to a support without a shock absorbing assembly. The external loads or external impact loads of particular interest to the failure of the heating element 102 of the gas igniter 100 illustrated in FIG. 1, are those that can be applied in one of the directions transverse to a longitudinal axis of the heating element 102. The shock absorbent mounting bracket 106 is generally made of a material having a thickness and firmness sufficient to resist external impact loads applied to the gas igniter 100 when the gas igniter is secured directly to the support surface 304. The material for forming the mounting bracket 106 can be any of a number of materials known in the art that are appropriate for the environment (e.g., temperature, humidity, pressure conditions) of the intended use as well as to resist an external load applied to the heating element 102. Generally, the firmness and thickness of the material being chosen are considered in combination for a given application.

Now referring to FIG. 10, there is shown a simplified schematic view of a heating device 300, comprising one of an appliance or a heating apparatus, having gas igniter 100 mounted to support surface 304 in accordance with the present disclosure. The heating device 300 being illustrated is described hereinafter as being used with a gaseous hydrocarbon (such as natural gas, propane) as the material to be combusted therein to produce the heat energy. This shall not be construed as a limitation to the present disclosure. The heating device 300 includes the gas igniter 100, the burner tube 304, control circuitry 306, a fuel admission valve 308 and the power switch 128. The control circuitry 306 is electrically interconnected to the fuel admission valve 308 and the power switch 128 so as each can be selectively operated to produce heat energy as hereinafter described. The fuel admission valve is fluidly interconnected using piping or tubing to a source 310 of a combustible material as the fuel for the heating device 300. The power switch 128 is electrically interconnected to the source of electrical power 126 and is electrically interconnected to the gas igniter 100 via lines 316. The power source 126 generally has sufficient capacity to heat-up the heating element 102 of the gas igniter 100 to the temperature required for ignition of the combustible mixture. The electrical power source is any of a number of sources of electrical power known to those skilled in the art. The control circuitry 306 is electrically interconnected to an external switch device 320 that provides the appropriate signals to the control circuitry for appropriate operation of the heating device 300.

In use, the control circuitry 306 receives a signal from the eternal switch device 320 calling for the heating device 300 to be turned on. In response to such a signal, the control circuitry 306 actuates the power switch 128 thereby causing electricity to flow through the heating element 102 of the gas igniter 100 to heat the heating element to the desired temperatures for causing a fuel/air mixture to ignite. After the heating element 102 is heated to the desired temperature, the control circuitry 306 actuates the fuel admission valve 308 so that fuel flows through the burner tube 304 to the heating element 102. As is known in the art, air is mixed with the fuel that is presented to the heating element so that a combustible mixture is thereby created and ignited by the heating element. This ignited fuel/air mixture is passed to the combustion area so that useable heat energy can be extracted and used for the intended purpose of the heating device. A sensor 326 is typically located proximal the heating element 102 to sense the temperature of the heating element and/or the temperature of the area in which the fuel/air mixture is being ignited by the heating element. When the heating function is completed, the control circuitry 306 again receives a signal from the external switch device 320 calling for the heating device to be turned off. In response to such a signal, the control circuitry closes the fuel admission valve 308 to cut off the flow of fuel, thereby stopping the combustion process.

Although one type of a gas igniter 100 is illustrated in FIGS. 2 and 3, the teachings of the present disclosure can be adapted for use to secure other types of hot surface igniters as well as other types of ignition devices or igniters to an associated support surface of a heating device. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A gas igniter comprising:

a heating element having rear poles;

a bushing formed of a rigid electrically insulating material for supporting the heating element, the bushing defining a first cavity and a second cavity, the first and second cavities adapted to laterally receive and electrically isolate the rear poles of the heating element, the bushing including a laterally oriented slot extending through the bushing; and a mounting bracket including a connecting portion, the connecting portion being inserted through the slot, an end section of the connecting portion being configured to engage the bushing for connecting the mounting bracket to the bushing, the connecting portion of the bracket includes first and second bendable tabs, the first and second tabs extending through the slot, the bracket being secured to the bushing by bending the first and second tabs in opposite directions toward the bushing.

2. A gas igniter comprising:

a heating element;

a bushing formed of a rigid electrically insulating material for supporting the heating element, the bushing including an elongated slot extending through the bushing; and a mounting bracket including a connecting portion and a mounting portion, the connecting portion including at least one bendable flap at a distal end of the connecting portion, the connecting portion of the mounting bracket and the at least one bendable flap being insertable through the elongated slot located on the bushing for connecting the mounting bracket to the bushing, the at least one bendable flap being bendable after it is inserted through the elongated slot to secure the mounting bracket to the bushing, the mounting portion of the mounting bracket being configured to attach the gas igniter to an associated object;

wherein the bushing defines a first cavity, a second cavity, and a wall that is integral with the bushing and formed of the rigid electrically insulating material, the first and second cavities adapted to laterally receive and electrically isolate rear poles of the heating element, the first and second cavities being separated by the wall, the wall including the elongated slot.

3. The gas igniter of claim 2, wherein the bushing is rectangular shaped and includes opposed side walls and opposed end walls, the elongated slot extending laterally between the side walls and being equally spaced from the end walls.

4. The gas igniter of claim 3, wherein one of the side walls has spaced apart openings for receiving the rear poles of the heating elements and the other side wall includes spaced apart openings for electrical leads.

5. The gas igniter of claim 3, wherein each end of the elongated slot is spaced from one of the side walls of the bushing.

6. The gas igniter of claim 2, further including an adhesive located in the first and second cavities for fixedly securing the rear poles of the heating element in the bushing.

7. The gas igniter of claim 6, wherein the adhesive is high temperature ceramic cement.

8. The gas igniter of claim 2, wherein the bracket is made from a single strip of shock resistant metal and is U-shaped for receiving the bushing, the bracket including a base portion spanning between the connecting and mounting portions, the base portion having an offset section connected to the first connecting portion so that a length of the connecting portion is less than a length of the mounting portion.

9. The gas igniter of claim 8, wherein the offset section of the base portion together with the connecting portion spaces the bushing from the mounting portion.

10. The gas igniter of claim 8, wherein the mounting portion of the bracket includes spaced apart mounting apertures by which the bracket is secured to the associated object.

11. A gas igniter comprising:

a heating element;

a bushing formed of a rigid electrically insulating material for supporting the heating element, the bushing including an elongated slot extending through the bushing; and a mounting bracket including a connecting portion and a mounting portion, the connecting portion including at least one bendable flap at a distal end of the connecting portion, the connecting portion of the mounting bracket and the at least one bendable flap being insertable through the elongated slot located on the bushing for connecting the mounting bracket to the bushing, the at least one bendable flap being bendable after it is inserted through the elongated slot to secure the mounting bracket to the bushing, the mounting portion of the mounting bracket being configured to attach the gas igniter to an associated object, the at least one flap includes a first and a second flap, the first and second flaps being bent towards the bushing for the securing of the connecting portion of the bracket from moving out of the elongated slot.

12. A gas igniter comprising:

a heating element;

a bushing formed of a rigid electrically insulating material for supporting the heating element, the bushing including an elongated slot extending through the bushing; and a mounting bracket including a connecting portion and a mounting portion, the connecting portion of the mounting bracket being inserted through the elongated slot located on the bushing for connecting the mounting bracket to the bushing, the mounting portion of the mounting bracket being configured to attach the gas igniter to an associated support surface, the connecting portion of the bracket includes at least one flap, the at least one flap extending through the elongated slot and being bent towards the bushing for preventing the first portion of the bracket from moving out of the elongated slot, the at least one flap includes first and second flaps, the bracket being secured to the bushing by bending the first and second flaps in opposite directions toward the bushing.

13. A gas igniter comprising:

a heating element having rear poles;

a bushing formed of a rigid electrically insulating material for supporting the heating element, the bushing having a first side and a second side and defining a first cavity and a second cavity facing the first side, the first and second cavities adapted to laterally receive and electrically isolate the rear poles of the heating element, the bushing further including an outer perimeter extending about the first and second cavities and a laterally oriented opening spaced from the perimeter and extending through the bushing between the first and second sides; and a mounting bracket including a connecting portion, the connecting portion being insertable through the opening from the first to the second side, an end section of the connecting portion having at least one flap configured to engage the second side of the bushing for connecting the mounting bracket to the bushing after the connecting portion is inserted through the opening.

14. The gas igniter of claim 13, wherein the first and second cavities are separated by a laterally extending wall, the wall including the opening.

15. The gas igniter of claim 13, wherein the connecting portion of the bracket extends orthogonally through the elongated opening of the bushing.

16. The gas igniter of claim 13, wherein the bracket is U-shaped, the bracket further including a mounting portion and a base portion spanning between the connecting portion and the mounting portion, the mounting portion being configured to attach the gas igniter to an associated object, the base portion having an offset section connected to the first portion, the offset section of the base portion together with the connecting portion spacing the bushing from the mounting portion.

17. The gas igniter of claim 13, further comprising high temperature ceramic adhesive located in the first and second cavities for fixedly securing the rear poles of the heating element in the bushing.

18. The gas igniter of claim 16, wherein the bracket further includes a shock absorbing section between the mounting portion and the base portion, the shock absorbing section reducing vibrations in the bushing when the igniter is in operation.

19. The gas igniter of claim 18, wherein the shock absorbing section includes an arcuate metal portion between the mounting portion and the base portion.

20. A flat igniter comprising:

a heating element having rear poles;

a rectangular shaped bushing formed of a rigid electrically insulating material for supporting the heating element, the bushing defining a first cavity and a second cavity separated from the first cavity by a laterally extending wall that is integral with the bushing and formed of the generally rigid electrically insulating material, the first and second cavities adapted to laterally receive and electrically isolate the rear poles of the heating element, the bushing including an elongated slot located on the wall and extending through the bushing;

high temperature ceramic adhesive located in the first and second cavities for fixedly securing the rear poles of the heating element in the bushing; and a mounting bracket including a connecting portion and a mounting portion, the connecting portion being insertable through the elongated slot, an end section of the connecting portion extending through the slot including at least one bendable flap configured to be bent after it is inserted through the elongated slot and the at least one bent flap engaging the bushing for firmly connecting the mounting bracket to the bushing, the mounting portion being configured to attach the flat igniter to an associated object.

21. The flat igniter of claim 20, wherein the bracket is U-shaped, the bracket further including a base portion spanning between the connecting portion and the mounting portion, the base portion having an offset section connected to the connecting portion such that a length of the connecting portion is less than a length of the mounting portion, the offset section of the base portion together with the connecting portion spacing the bushing from the mounting portion.

22. A flat igniter comprising:

a heating element having rear poles;

a rectangular shaped bushing formed of a rigid electrically insulating material for supporting the heating element, the bushing defining a first cavity and a second cavity separated from the first cavity by a laterally extending wall that is integral with the bushing and formed of the rigid electrically insulating material, the first and second cavities adapted to laterally receive and electrically isolate the rear poles of the heating element, the bushing including an elongated slot located on the wall and extending through the bushing; and a mounting bracket including a connecting portion and a mounting portion, the connecting portion including at least one bendable flap configured to bend from an installable condition to a bent condition, wherein the connecting portion and the at least one bendable flap is insertable through the elongated slot when in the installable condition and wherein the at least flap secures the mounting bracket relative to the bushing when in the bent condition thereby firmly connecting the mounting bracket to the bushing, the mounting portion being configured to attach the flat igniter to an associated object.

* * * * *